US007699001B2

(12) United States Patent
Klauss et al.

(10) Patent No.: US 7,699,001 B2
(45) Date of Patent: Apr. 20, 2010

(54) APPARATUS FOR PRESSING A COVERING ONTO A PRINTING-UNIT CYLINDER FOR A ROTARY PRESS

(75) Inventors: Steffen Klauss, Plauen (DE); Günter Koppelkamm, Neuensalz (DE); Reinhard Naumann, Schkeuditz/Walteritz (DE); Frank Oertel, Langenwetzendorf (DE)

(73) Assignee: MAN Roland Druckmaschinen AG, Offenback am Main (DE)

( * ) Notice: Subject to any disclaimer, the term of this patent is extended or adjusted under 35 U.S.C. 154(b) by 842 days.

(21) Appl. No.: 11/404,463

(22) Filed: Apr. 13, 2006

(65) Prior Publication Data

US 2006/0230960 A1 Oct. 19, 2006

(30) Foreign Application Priority Data

Apr. 13, 2005 (DE) ..... 10 2005 017 182

(51) Int. Cl.
*B41F 27/12* (2006.01)

(52) U.S. Cl. ..... 101/477; 101/415.1; 101/479

(58) Field of Classification Search ..... 101/477, 101/479, 480, 415.1
See application file for complete search history.

(56) References Cited

U.S. PATENT DOCUMENTS

| | | | | |
|---|---|---|---|---|
| 5,617,792 | A | 4/1997 | Rau et al. | |
| 5,709,151 | A * | 1/1998 | Durr et al. | 101/477 |
| 2003/0167951 | A1 * | 9/2003 | Schroder et al. | 101/477 |
| 2006/0266236 | A1 * | 11/2006 | Rasch et al. | 101/216 |

FOREIGN PATENT DOCUMENTS

| | | | |
|---|---|---|---|
| DE | 102 38 177 | | 2/2004 |
| EP | 0 739 728 | | 10/1996 |
| JP | 9501115 | T * | 2/1997 |
| JP | 2006092050 | A * | 4/2006 |
| WO | WO 9519263 | A1 * | 7/1995 |
| WO | WO 2004103706 | A2 * | 12/2004 |

OTHER PUBLICATIONS

Search Report dated Apr. 13, 2005 issued for the corresponding German Application No. 10 2005 017 182.6.

* cited by examiner

*Primary Examiner*—Leslie J Evanisko
(74) *Attorney, Agent, or Firm*—Cohen Pontani Lieberman & Pavane LLP

(57) ABSTRACT

A plurality of longitudinal channels for supplying pressure medium are arranged within a carrier having a closed profile. A plurality of operating cylinders have pressure spaces which are flow-connected to the channels for moving the pressure rollers inward and outward in order to press coverings onto a printing unit cylinder.

17 Claims, 6 Drawing Sheets

APPARATUS FOR PRESSING A COVERING ONTO A PRINTING-UNIT CYLINDER FOR A ROTARY PRESS

BACKGROUND OF THE INVENTION

1. Field of the Invention

The invention relates to an apparatus and a method for pressing a covering onto a printing-unit cylinder of a rotary press with the aid of at least one pressure roller which can be set against the printing-unit cylinder by means of an operating cylinder.

2. Description of the Related Art

U.S. Pat. No. 5,617,792 shows pressure rollers which are arranged along a forme cylinder on a carrier and can be set against a flexible printing forme which is situated on the forme cylinder by means of pneumatic operating cylinders. The pressure spaces of the operating cylinders are fed with compressed air via hoses.

In this apparatus, it is disadvantageous that the expenditure and space requirement for the routing of the hose lines rises with an increasing number of operating cylinders.

SUMMARY OF THE INVENTION

It is an object of the invention to provide an apparatus for pressing a covering against a printing-unit cylinder, which apparatus is distinguished by a low space requirement and can be produced inexpensively. Moreover, a method is to be provided.

According to the invention, the carrier has a closed profile and a plurality of longitudinal channels within the closed profile. The channels are flow-connected to pressure spaces in the operating cylinder, and can be supplied with a pressure medium. The apparatus makes it possible to omit hose lines which are replaced by the channels of the carrier. Moreover, the closed profile makes possible to configure the carrier with a small cross section which saves space and weight. Furthermore, the carrier makes it possible to mount the operating cylinders with low expenditure. It is also possible to modify the apparatus in a simple manner for a different number of operating cylinders and pressure rollers and thus for printing-unit cylinders of different width. Overall, cost-saving manufacturing of the apparatus is possible for a wide variety of installation variants.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

DETAILED DESCRIPTION OF THE PRESENTLY PREFERRED EMBODIMENTS

Figure 1:
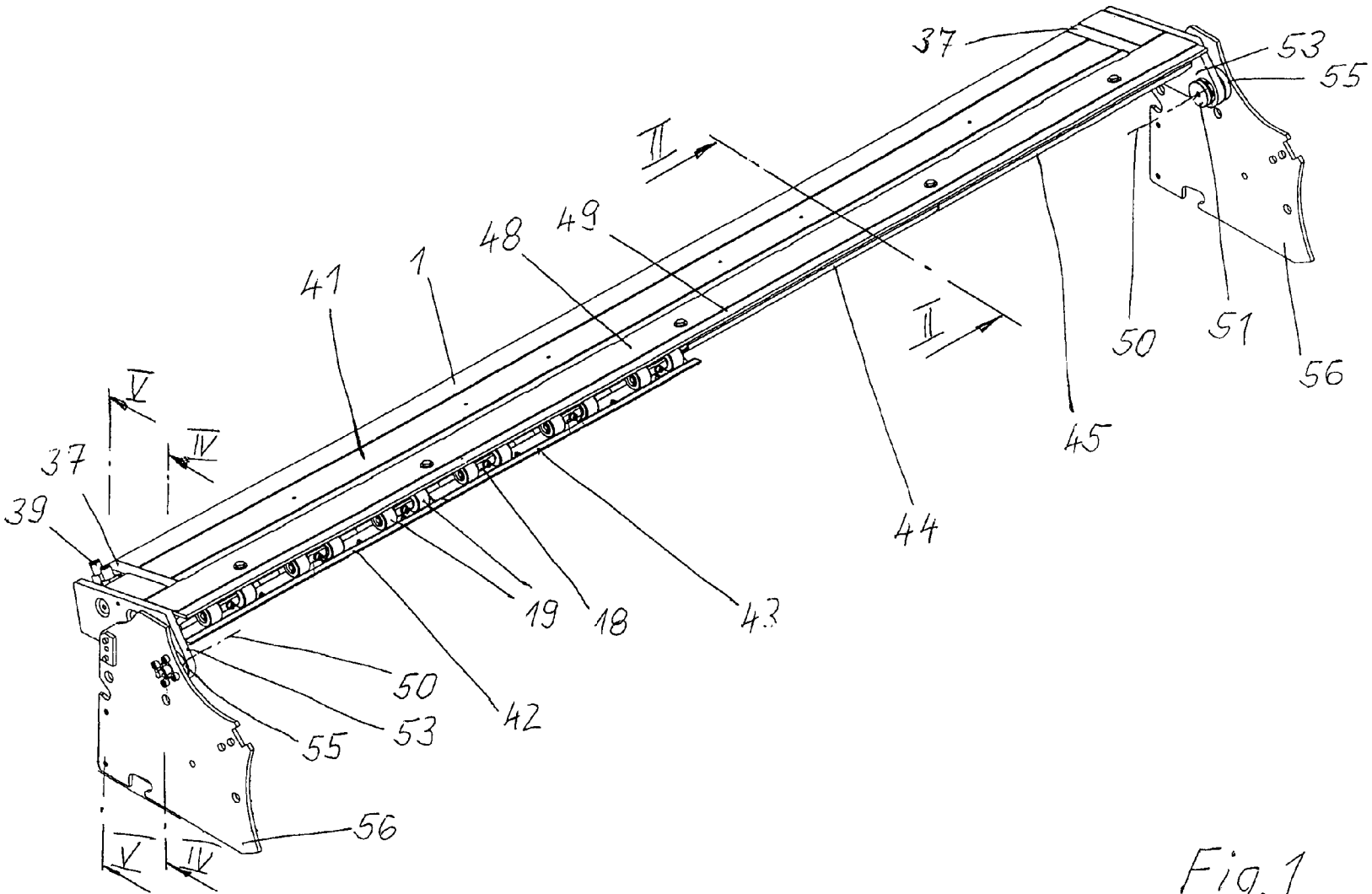
FIG. 1 is a perspective view of an apparatus for pressing a covering.
Figure 2:
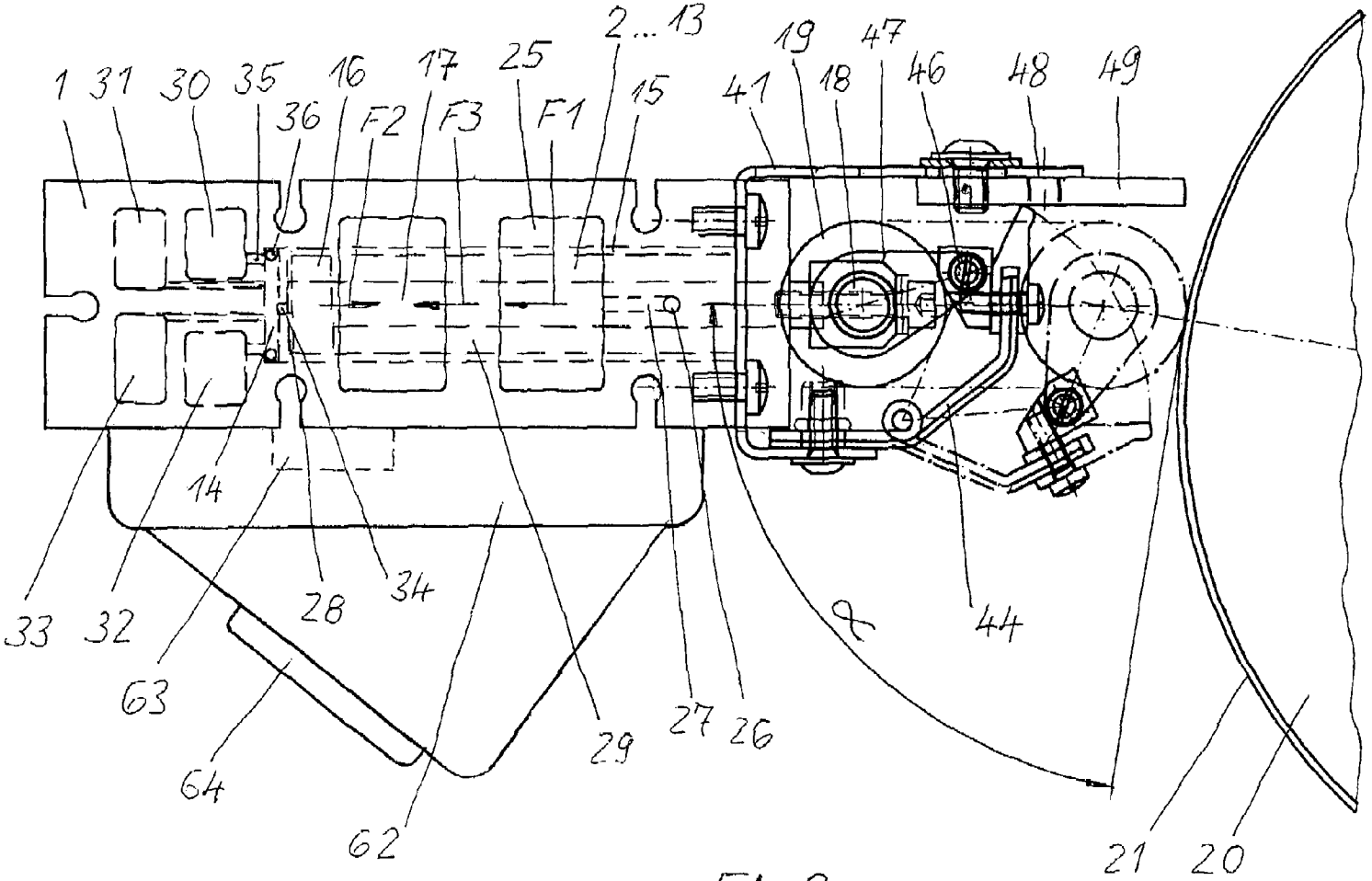
FIG. 2 is a section view along the line II-II according to FIG. 1.
Figure 6:
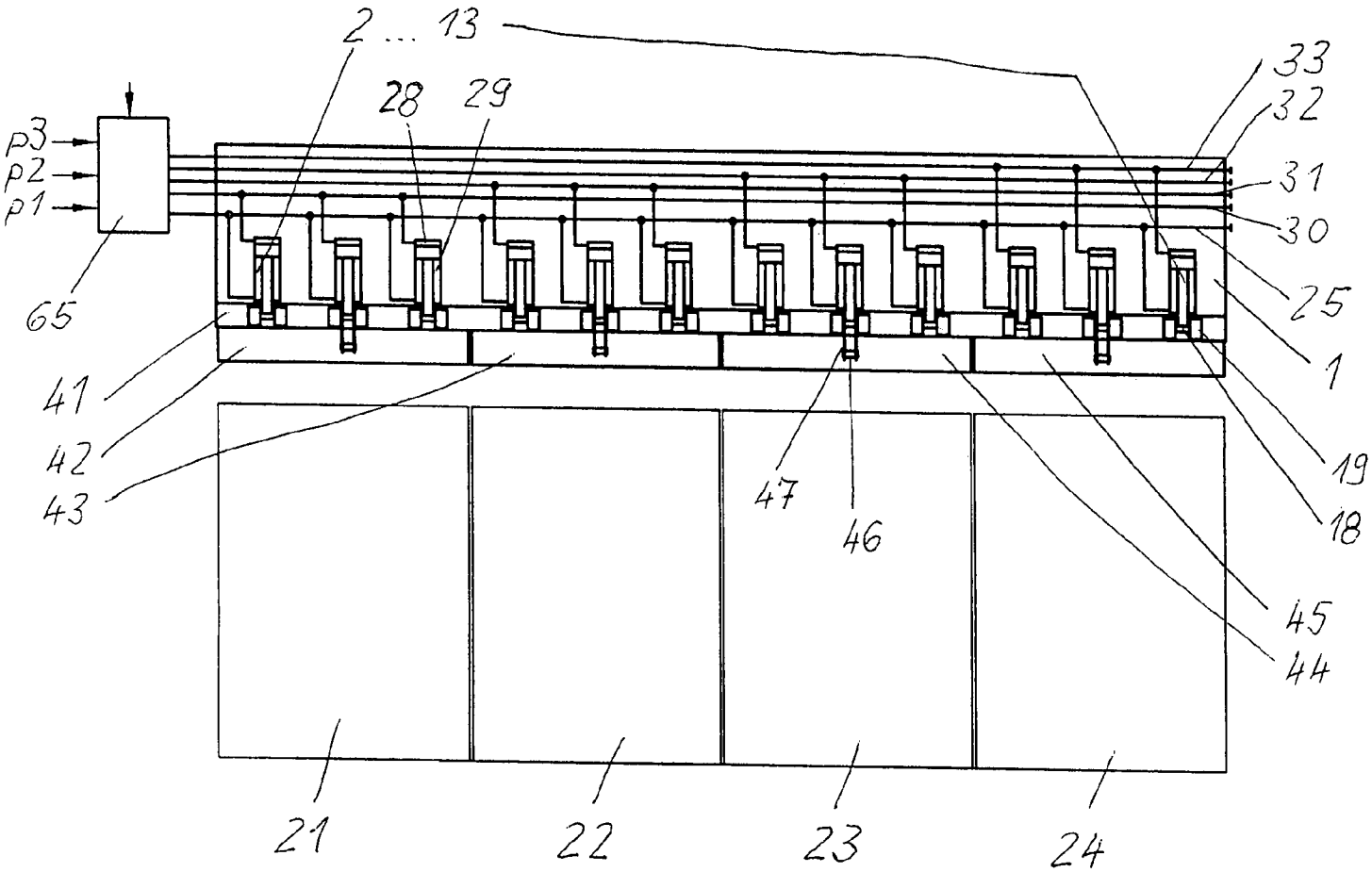
FIG. 6 is a plan view of the carrier with an illustration of the pressure-medium routing.

The apparatus shown in FIG. 1 includes a carrier 1 having a closed profile, as shown in FIG. 2. Arranged next to one another in its longitudinal direction, the carrier 1 has twelve operating cylinders 2 to 13 which are plugged and fastened into in each case one bore 14. Instead of the pneumatic operating cylinders 2 to 13, hydraulic operating cylinders could also be used. The operating cylinders 2 to 13 advantageously have a cup-shaped sleeve 15, in which a piston 16 together with the piston rod 17 are situated. An axle 18 is fastened to each piston rod 17, on which axle 18 two pressure rollers 19 are mounted rotatably (FIGS. 1, 6). Instead of this, only one pressure roller 19 could also be mounted in a fork, for example, on a piston rod 17.

Figure 5:
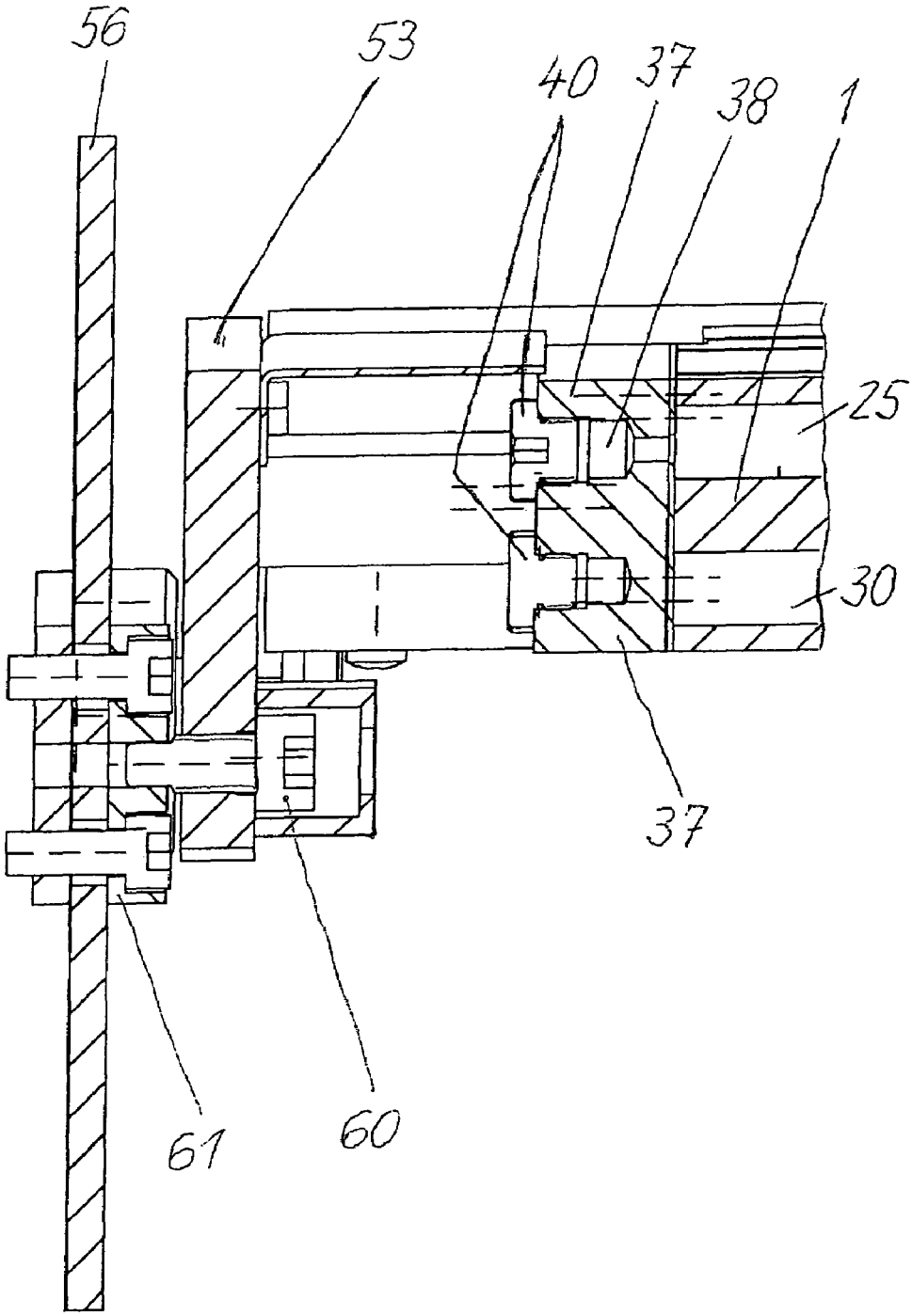
FIG. 5 is a section view along the line V-V according to FIG. 1, the variant of the screw plugs which are screwed into the end plate being shown, inter alia.

The apparatus is arranged along a forme cylinder 20 which bears four printing formes 21 to 24 next to one another in the axial direction. FIG. 6 shows these printing formes 21 to 24 diagrammatically. Instead of on a forme cylinder, the apparatus can also be arranged, for example, on a transfer cylinder which bears a rubber blanket as covering. In the longitudinal direction, the carrier 1 has a first channel 25 which is flow-connected to the first pressure spaces 29 for moving the pressure rollers 19 inwards, that is to say to the piston-rod-side pressure spaces, of all the operating cylinders 2 to 13. For this purpose, the cylinder 15 has a bore 26 which is connected via a channel system 27 to the first channel 25 (FIG. 2). Furthermore, of the operating cylinders 2 to 13 which are assigned to a printing forme 21 to 24, the second pressure spaces 28 for moving the pressure rollers 19 outwards, that is to say the piston-base-side pressure spaces, are flow-connected in each case to a separate channel 30 to 33. In detail, the piston-base-side pressure spaces of the operating cylinders 2 to 4 are flow-connected to the channel 30, the piston-base-side pressure spaces of the operating cylinders 5 to 7 are flow-connected to the channel 31, the piston-base-side pressure spaces of the operating cylinders 8 to 10 are flow-connected to the channel 32 and the piston-base-side pressure spaces of the operating chambers 11 to 13 are flow-connected to the channel 33. In order to produce this connection, the base of the cylinder 15 is provided with a hole 34. Moreover, the bore 14 is connected via a transverse bore 35 to the associated channel 30 or 31 or 32 or 33. The bore 14 is sealed with a circular ring 36 with respect to the base of the cylinder 15. In each case one end plate 37 is screwed to the longitudinal-side ends of the carrier 1, which end plate 37 has threaded bores 38, into which the channels 25, 30 to 33 of the carrier 1 open. While nipples 39 for the connection of the hoses which supply the compressed air are screwed into the threaded bores 38 in one end plate 37 (FIG. 1), the threaded bores 38 of the other end plate 37 are closed with screw plugs 40 (FIG. 5). Owing to the termination of the carrier 1 with the end plates 37, which is always uniform, apparatuses for printing-unit cylinders of different length can be realized simply, as the printing-unit cylinders differ substantially only in the length of the carrier 1 and in the number of bores 14 for the accommodation of the operating cylinders 2 to 13. The optional fitting of the end plates 37 with nipples 39 or screw plugs 40 affords the possibility, even in different installation positions of the apparatus, for example on printing-unit cylinders which rotate to the right or to the left, of always supplying the compressed air into the apparatus from the same frame side of a printing unit. The carrier 1 is advantageously manufactured from a lightweight metal extruded profile. As a closed profile, the profile already contains the channels 25, 30 to 33 for the supply of air and can be provided with further cut-outs which permit optimization of high rigidity and low mass.

The pressure rollers 19 are arranged in a protective housing 41 which is closed in the direction of the forme cylinder 20 with four opening flaps 42 to 45 which are arranged next to one another. Here, each printing forme 21 to 24 is assigned in each case one opening flap 42 to 45 (FIG. 6). The opening flaps 42 to 45 can be moved away from an adjustment region of the pressure rollers 19 which is situated between the pressure rollers 19 and the forme cylinder 20. For this purpose, the opening flaps 42 to 45 are mounted pivotably on the protective housing 41 and bear a rotary joint 46, on which a coupler 47 is articulated which is connected pivotably to the piston rod 17 of an operating cylinder 2 to 13. The coupler 47 is advantageously mounted rotatably on the axle 18 which is fastened to the piston rod 17 (FIGS. 6 and 2). The piston rod 17, the coupler 47, the opening flap 42 to 45 and the protective housing 41 form a thrust crank mechanism. As a result of this mechanism connection of the opening flaps 42 to 45 to in each case one operating cylinder, the opening flaps 42 to 45 are opened or closed when the pressure rollers 19 are moved outwards and inwards, with the omission of separate drives. The applicability of the drive of the opening flaps is not restricted to the described embodiment of the carrier of the apparatus for pressing a covering.

Figure 3:
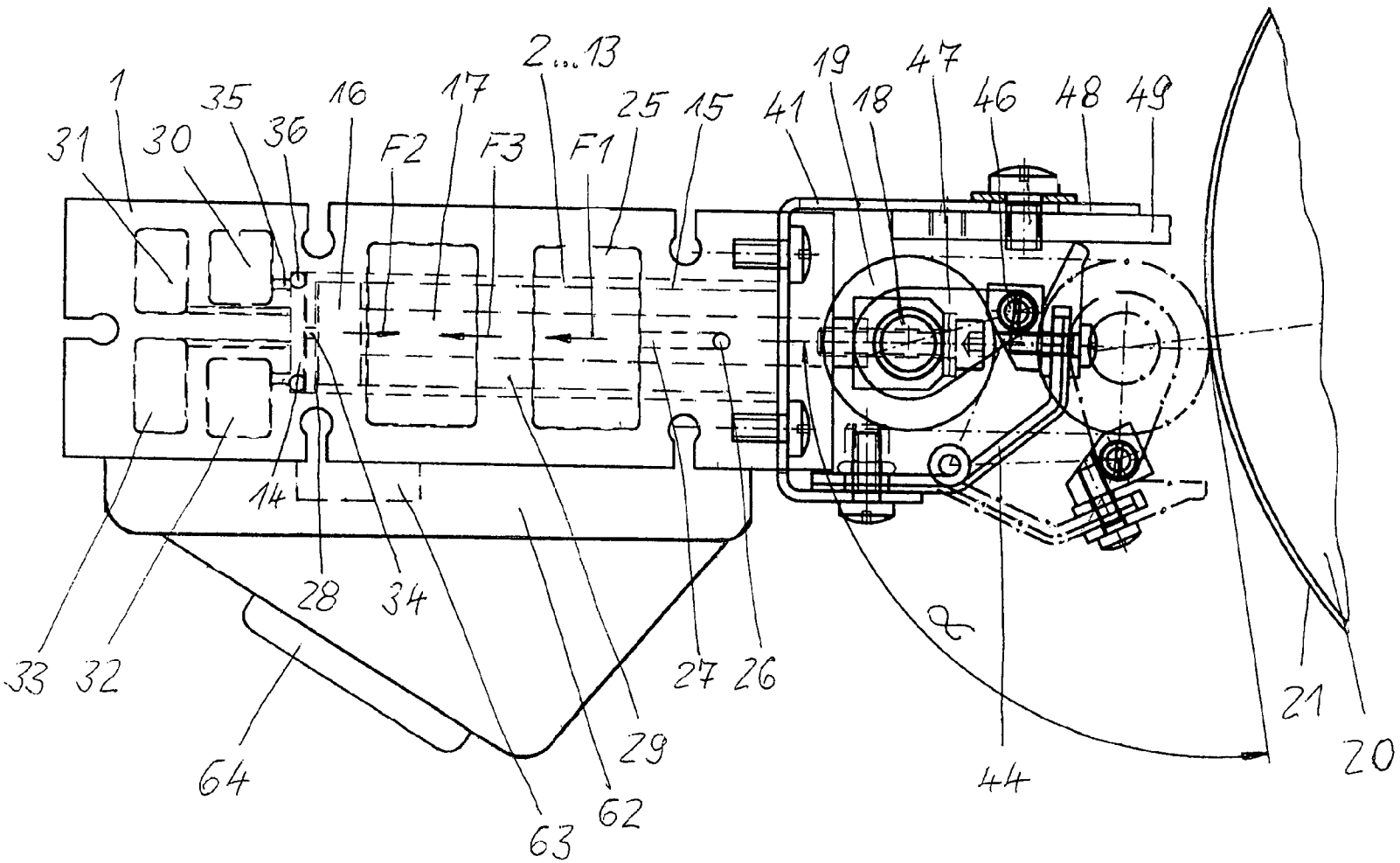
FIG. 3 shows a mounting variant to FIG. 2.

The protective housing 41 has a U-shaped cross section, a limb 48 and the opening flap 42 to 45 in the open state serving as a protective means for the inlet gaps between the pressure rollers 19 and the forme cylinder 20. Here, a bar 49 which can be moved to the inlet gap is screwed onto one limb 48 (FIGS. 2 and 3).

Figure 4:
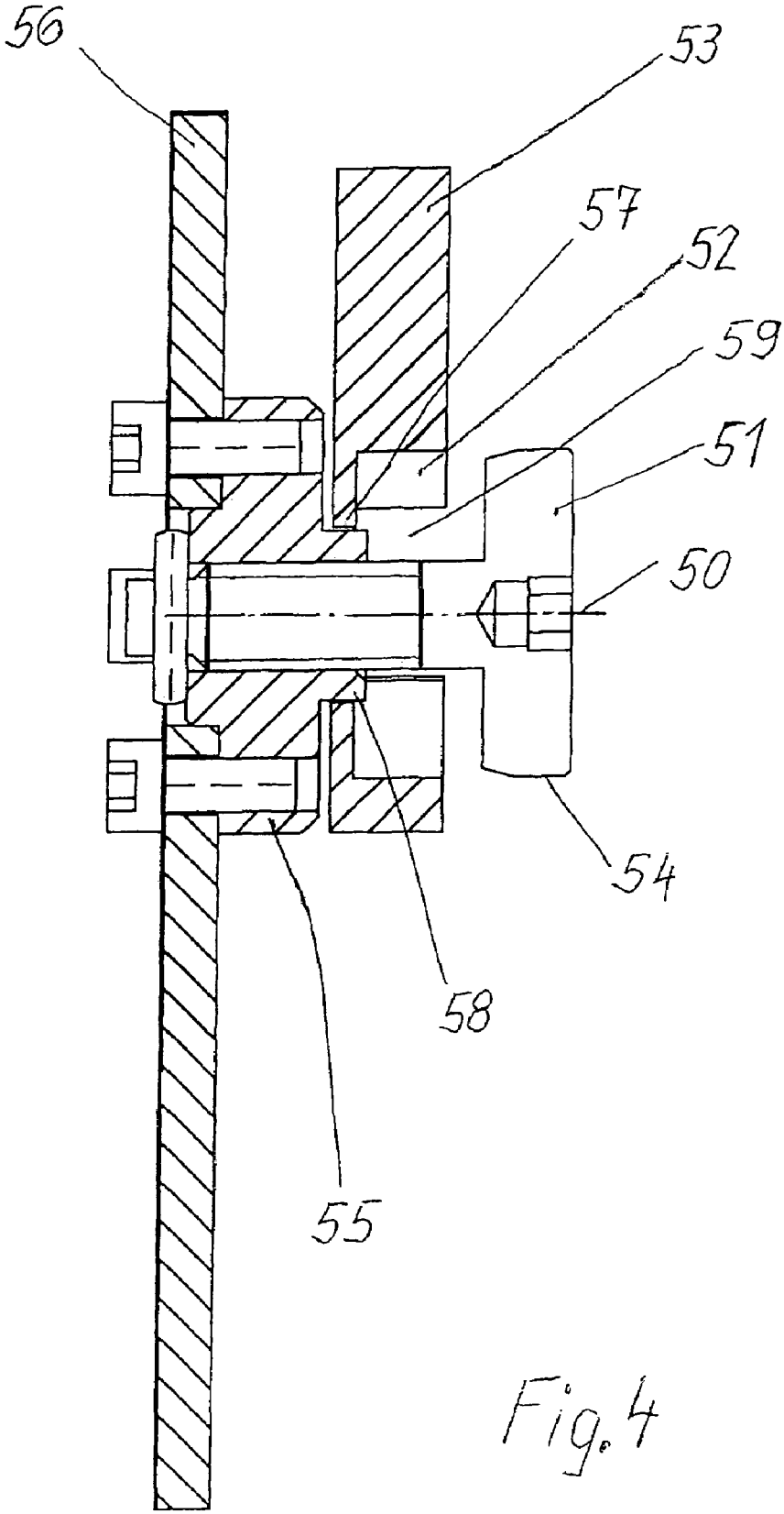
FIG. 4 is a section view along the line IV-IV according to FIG. 1.

The apparatus can be pivoted away from the forme cylinder about an axis 50. For this purpose, the apparatus is mounted on two threaded bolts 51 which are screwed into the frame and are arranged on the axis 50 (FIG. 4). In detail, in each case one support plate 53 is fastened to the ends of the carrier 1, which support plate 53 contains a countersunk bore 52, with which the support plate 53 is mounted on a collar 54 of the threaded bolt 51. Every threaded bolt 51 is screwed indirectly into the frame of the rotary press, to be precise into a bush 55 which is screwed to a metal side plate 56 which is fastened in the frame of the rotary press. The support plate 53 also has a through hole 57 centrally with respect to the countersunk bore 52, into which through hole 57 a cylindrical projection 58 of the bush 55 protrudes. From this hole 57, a slot 59 which also encloses the countersunk bore 52 leads to the edge of the support plate 53.

The operating position of the apparatus is fixed by screws 60 which are screwed into the support plates 53 and spaced apart on the axis 50. A projection of every screw 60 protrudes into a fixing plate 61 which is screwed adjustably to the metal side plate 56 in a manner which makes it possible to adjust the angle of attack $\alpha$ of the apparatus on the forme cylinder 20.

An operating channel 62 is arranged on the longitudinal side of the carrier 1 (FIGS. 2, 3), which operating channel 62 contains sensors 63 for signaling the opening state of the opening flaps 42 to 45 and an operating switch 64, in a manner which is assigned to every region of a printing forme 21 to 24, for controlling a changing process of the printing formes 21 to 24. The sensor 63 can, for example, sense a magnetic field of the piston 16 of that operating cylinder 2 to 13 which drives the opening flap 42 to 45 via the coupler 47. The elements of the operating channel 62 are arranged symmetrically. Furthermore, the hose connections and connections for the electric lines can be led out optionally at every end of the operating channel 62. This permits pre-installation of all the components. Moreover, the operating channel 62 can be screwed onto the side which faces the operator, independently of the installation position of the apparatus. All required installation variants can be realized advantageously by these possibilities of assembly of the operating channel 62 and the apparatus.

According to FIG. 2, the apparatus is set against the forme cylinder 20 at an acute angle of attack $\alpha$. The angle between the thrust direction of an operating cylinder 2 to 13 and the tangent on the forme cylinder 20 at the throwing-on point of the pressure roller 19 is defined as the angle of attack $\alpha$, measured on the underside of the apparatus. The bar 49 is screwed on the limb 48 of the protective housing 41 in such a way that only a small inlet gap to the forme cylinder 20 is produced. In comparison with this, according to FIG. 3, the apparatus is arranged at an obtuse angle of attack $\alpha$ on the forme cylinder 20. Here, the bar 49 is screwed on the limb 48 in a correspondingly offset manner, in order once again to attain a small inlet gap. Moreover, the apparatus has been arranged closer to the cylinder 20, that is to say operation is carried out with a shorter throwing-on path of the pressure rollers 19, in order to set the desired size of the inlet gap at the opening flap 42 with the associated position of the opened opening flap 42. The moved-out state of the pressure roller 19, that is to say its contact position on the forme cylinder 20, is shown in FIGS. 2 and 3 with dash-dotted lines.

For certain operating processes, for example the changing of rubber blankets or the moving out and in of inking and damping rolls and their adjustment, the apparatus can be pivoted or dismantled. After the screws 60 have been loosened and their projection has been rotated out of the fixing plates 61 (FIG. 5), the apparatus can be pivoted on the respective collar 54 of the threaded bolts 51 about the axle 50 (FIG. 4). After the collar 54 of the threaded bolts 51 has been screwed out of the region of the countersunk bores 52, the apparatus can be pulled out of the region of the threaded bolts 51 via the slots 59 and can be removed from the rotary press.

The printing forme 21 to 24 is pressed on by moving the pressure rollers 19 which are assigned to it outwards against the forme cylinder 20 within the context of a plate-change operation which can be initiated via the machine controller or at the operating switches 64. The moving out and in of the pressure rollers 19 takes place by targeted action on the operating cylinders 2 to 13, which takes place by means of a valve control unit 65 (FIG. 6). The valve control unit 65 is supplied with compressed air at three different pressures, to be precise at $p1 \approx 1$ bar $p2 \approx 5$ bar $p3 \approx 3$ bar.

In order to hold all the pressure rollers 19 in the moved-in state, compressed air at the pressure p1 is supplied to the first channel 25. Here, a pulling-in force F1 is produced in all the operating cylinders 2 to 13. In order, for example, to move the pressure rollers 19 which are assigned to the printing formes 21 and 22 outwards counter to this pressure and the forme cylinder 20 (the state is shown in FIG. 1), compressed air at the pressure p2 is supplied to the channels 30 and 31, which compressed air produces a moving-out force F2 in the second pressure spaces 28 for moving outwards into the operating cylinder 2 to 7, which force F2 is greater than the force F1. The channels 30 and 31 are switched to a pressureless state for moving the pressure rollers 19 which are assigned to the printing formes 21 and 22 inwards. This brings about the situation where the force F1 which acts in the first of the operating cylinders 2 to 7 inwards pulls the pistons 16 in. However, it is advantageous if compressed air at the pressure p3 is applied to the first channel 25, the pulling-in force F3 being produced in the operating cylinders 2 to 7, which force F3 is smaller than the force F2. Despite the action of the force F3, further pressure rollers 19 which are set against the forme cylinder 20 optionally continue to exert their pressing function sufficiently. The forces are measured, for example, to be F1≈10 N, F2≈120 N and F3≈50 N.

For the case where only one printing forme, for example the printing forme 21, is to be changed and the clamping system of the forme cylinder 20 releases a second printing forme 22 at the same time, the latter continues to be held reliably on the forme cylinder 20 by the associated pressure rollers 19 and is clamped fixedly again together with the clamping of the new printing forme 21 by the clamping system of the forme cylinder 20. Secondly, it is possible, in forme cylinders 20 with separate clamping systems per printing forme 21 to 24, to set the pressure rollers 19 against the cylinder only in the case of one printing forme 21 to 24 by feeding the corresponding channel 30 to 33.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. An apparatus for pressing a covering onto a printing unit cylinder of a rotary press, the apparatus comprising:

a carrier having a closed profile;

a plurality of longitudinal channels within an interior of said closed profile;

a plurality of operating cylinders each having a first pressure space and a second pressure space flow-connected to said channels; and a plurality of pressure rollers connected to said plural operating cylinders so that said plural pressure rollers can be set against the printing unit cylinder by supplying pressure medium to said plural operating cylinders;

first piston-rod side pressure spaces corresponding to one of the first and the second pressure spaces of each of the plural operating cylinders are flow-connected to a first longitudinal channel of said plural longitudinal channels positioned within said closed profile; and second piston-base-side pressure spaces corresponding to the other of the first and the second pressure space of each of the plural operating cylinders are each flow-connected to a separate second longitudinal channel of said plural longitudinal channels positioned within said closed profile.

2. The apparatus of claim 1 wherein said carrier has a pair of opposed ends, said apparatus further comprising a pair of end plates fixed to respective ones of said ends, each said end plate having threaded bores which communicate with respective ones of said channels in said carrier, one of said end plates receiving screw plugs in said threaded bores, the other of said end plates receiving nipples in said threaded bores.

3. The apparatus of claim 1 further comprising:

a piston separating said first and second pressure spaces of each said plural operating cylinders;

a piston rod connected to each said piston and passing through said first pressure space; and an axle fixed to each said piston rod, each said axle having at least one pressure roller mounted for rotation thereon.

4. The apparatus of claim 1 further comprising:

a protective housing fixed to said carrier; and an opening flap pivotably mounted on said housing, said flap being pivotable between a closed position and an open position which permits said plural pressure rollers to be set against said printing unit cylinder.

5. The apparatus of claim 4 comprising a plurality of opening flaps, each opening flap corresponding to a respective covering on said printing unit cylinder.

6. The apparatus of claim 5 further comprising:

an operating channel on the carrier;

sensors in said channel for signaling the position of the flaps; and an operating switch assigned to each said covering for controlling a changing process of the covering.

7. The apparatus of claim 4 further comprising:

a piston separating said first and second pressure spaces of each of said plural operating cylinders;

a piston rod connected to each said piston and passing through said first pressure space; and a coupler which is pivotably mounted on the protective flap by a rotary joint, said coupler being pivotably connected to the piston rod.

8. The apparatus of claim 7 wherein the protective housing has a U-shaped cross-section and a limb which extends toward the printing unit cylinder, the apparatus further comprising a bar screwed to the limb, said bar and said protective cover, in the open position, protecting an inlet gap between the plural pressure rollers and the printing unit cylinder.

9. The apparatus of claim 1 further comprising a pair of bolts which can be fixed with respect to a frame of the rotary press, said bolts being arranged on an axis about which the carrier can be pivoted with respect to the frame.

10. The apparatus of claim 9 further comprising a pair of support plates fixed to opposite ends of the carrier, each said support plate having a countersunk bore communicating with a slot in the support plate, said bolts having collars received in said countersunk bores, whereby said apparatus can be removed from the press by screwing the bolts so that the collars are out of the countersunk bores.

11. The apparatus of claim 9 further comprising a pair of fixing plates which can be screwed to the frame of the rotary press so that the position of the plates on the frame is adjustable, said bolts being supported in said fixing plates, whereby the angle of the apparatus with respect to the printing unit cylinder is adjustable.

12. The apparatus of claim 1 wherein each of said operating cylinders comprises a sleeve fitted into a bore in the carrier.

13. The apparatus of claim 1 wherein the carrier is formed as an extrusion.

14. An apparatus for pressing a covering onto a printing unit cylinder of a rotary press, the apparatus comprising:

a carrier having a closed profile;

a plurality of longitudinal channels within said closed profile;

a plurality of pressure rollers for pressing a plurality of coverings onto said printing unit cylinder;

a plurality of operating cylinders each having a first pressure space and a second pressure space flow-connected to said channels;

wherein said operating cylinders are coupled for operating said pressure plural rollers;

wherein said plural pressure rollers are connected to said plural operating cylinders so that said plural pressure rollers are set against the printing unit cylinder by supporting pressure medium to said operating cylinders;

wherein said channels comprise a first channel flow-connected to the first pressure spaces for moving the plural pressure rollers inward, and at least one second channel flow-connected to the second pressure spaces for moving the pressure rollers outward in order to set the coverings on the printing unit cylinder;

wherein said carrier has a pair of opposed ends; and wherein said apparatus further comprising a pair of end plates fixed to respective said ends, each said end plate having threaded bores which communicate with respective said channels in said carrier, one of said end plates receiving screw plugs in said threaded bores, the other of said end plates receiving nipples in said threaded bores.

15. The apparatus of claim 14 further comprising a pair of fixing plates configured to be screwed from the frame of the rotary press so that the position of the fixing plates on the frame is adjustable, said bolts being supported in said fixing plates, whereby the angle of the apparatus with respect to the printing unit cylinder is adjustable.

16. An apparatus for pressing a covering onto a printing unit cylinder of a rotary press, the apparatus comprising:

a carrier having a closed profile;

a plurality of longitudinal channels within said closed profile;

an operating cylinder having a first pressure space and a second pressure space flow-connected to said channels;

a pressure roller connected to said operating cylinder so that said pressure roller can be set against the printing unit cylinder by supplying pressure medium to said operating cylinder;

a pair of bolts which can be fixed with respect to a frame of The rotary press, said bolts being arranged on an axis about which the carrier can be pivoted with respect to the frame;

a pair of support plates fixed to opposite ends of the carrier, each said support plate having a countersunk bore communicating with a slot in the plate, said bolts having collars received in said countersunk bores, whereby said apparatus can be removed from the press by screwing the bolts so that the collars are out of the countersunk bores.

17. An apparatus for pressing a covering onto a printing unit cylinder of a rotary press, the apparatus comprising:

a carrier having a closed profile;

a plurality of longitudinal channels within said closed profile;

an operating cylinder having a first pressure space and a second pressure space flow-connected to said channels;

a pressure roller connected to said operating cylinder so that said pressure roller can be set against the printing unity cylinder by supplying pressure medium to said operating cylinder; a protective housing fixed to said carrier;

a plurality of opening flaps, each opening flap corresponding to a respective covering on a said printing unit cylinder, each opening flap pivotably mounted on said housing, said flaps being pivotable between a closed position and an open position which permits said pressure roller to be set against said printing unit cylinder;

an operating channel on the carrier;

sensors in said channel for signaling the position of the flaps; and an operating switch assigned to each said covering for controlling a changing process of the covering.

* * * * *